US010808377B1

(12) United States Patent
Pino, Jr. et al.

(10) Patent No.: US 10,808,377 B1
(45) Date of Patent: Oct. 20, 2020

(54) MICROTRENCHER HAVING AN IMPROVED VACUUM SYSTEM AND METHOD OF MICROTRENCHING

(71) Applicant: CCIIP LLC, New York, NY (US)

(72) Inventors: Angleo J. Pino, Jr., New York, NY (US); Daniel Urban, Austin, TX (US)

(73) Assignee: CCIIP LLC, New York, NY (US)

( * ) Notice: Subject to any disclaimer, the term of this patent is extended or adjusted under 35 U.S.C. 154(b) by 0 days.

(21) Appl. No.: 16/806,335

(22) Filed: Mar. 2, 2020

Related U.S. Application Data

(60) Provisional application No. 62/959,496, filed on Jan. 10, 2020.

(51) Int. Cl.
*E02F 3/92* (2006.01)
*E02F 5/30* (2006.01)
*E02F 5/08* (2006.01)

(52) U.S. Cl.
CPC ..... *E02F 3/9225* (2013.01); *E02F 5/08* (2013.01); *E02F 5/30* (2013.01)

(58) Field of Classification Search
CPC ..... E02F 5/08; E02F 5/30; E02F 3/9225
See application file for complete search history.

(56) References Cited

U.S. PATENT DOCUMENTS

| | | | | |
|---|---|---|---|---|
| 4,668,548 | A | 5/1987 | Lankard | |
| 4,744,693 | A | 5/1988 | Smith | |
| 4,812,078 | A | 3/1989 | Rivard | |
| 5,074,044 | A * | 12/1991 | Duncan | B23D 59/006 125/13.01 |
| 5,244,304 | A | 9/1993 | Weil | |
| 5,913,638 | A | 6/1999 | Lansdale | |
| 7,914,618 | B1 | 3/2011 | Krozel | |
| 8,061,344 | B2 * | 11/2011 | Dofher | B28D 7/02 125/13.01 |
| 9,485,468 | B2 | 11/2016 | Pino | |
| 2004/0149174 | A1 | 8/2004 | Farrington | |
| 2005/0036749 | A1 | 2/2005 | Vogel | |
| 2011/0016754 | A1 * | 1/2011 | Ruhl et al. | E02F 3/183 37/94 |
| 2011/0070030 | A1 * | 3/2011 | Miller | E02F 5/12 405/180 |
| 2013/0011198 | A1 | 1/2013 | Purcell | |
| 2013/0284070 | A1 | 10/2013 | Dubey | |

(Continued)

FOREIGN PATENT DOCUMENTS

| | | |
|---|---|---|
| CA | 2348062 | 11/2001 |
| WO | 2016/088083 | 9/2016 |

OTHER PUBLICATIONS

King, "Google Fiber finishes digging very shallow grave in Louisville, KY. #RIP," https://www.pocketables.com/2019/021 Joogle-fiber-finishes-digging-very-shallow-grave-in-louisville-ky-rip.html, published on Pocketable on Feb. 7, 2019, pp. 1-9.

(Continued)

*Primary Examiner* — Tara Mayo-Pinnock
(74) *Attorney, Agent, or Firm* — Jeffrey S. Melcher; Melcher Patent Law PLLC

(57) ABSTRACT

A microtrencher having a vacuum system configured to clean spoil from a microtrench having a side shroud and a suction nozzle. A method of using the microtrencher to cut a microtrench in a roadway and using the vacuum system to clean spoil from the roadway and microtrench.

18 Claims, 11 Drawing Sheets

(56) References Cited

U.S. PATENT DOCUMENTS

| | | | | |
|---|---|---|---|---|
| 2014/0334878 | A1* | 11/2014 | Miller | E01C 23/0933 405/154.1 |
| 2015/0125218 | A1 | 5/2015 | Gustavsson | |
| 2016/0376767 | A1 | 12/2016 | Miller | |
| 2018/0106015 | A1 | 4/2018 | Pino | |
| 2018/0156357 | A1 | 6/2018 | Pino | |
| 2018/0292027 | A1 | 10/2018 | Pino | |
| 2019/0086002 | A1 | 3/2019 | Pino | |
| 2019/0136488 | A1* | 5/2019 | Cochran et al. | E02F 7/00 |
| 2019/0226603 | A1 | 7/2019 | Pino | |

OTHER PUBLICATIONS

Blum, "Microtrenching fail drives Google Fiber out of Louisville," https:/lwww.tellusventure.com/blog/microtrenching- ail-drives-google-fiber-out--of-louisville/, published on Tellus Venture Associates, Feb. 8, 2019, pp. 1-3.
Otts, "Where is Google Fiber? Mostly in the Highlands, records show," hllps://www.wdrb.com/news/business/sunday- 3edition-where-is-google-fiber-moslly-in-the-highlands/article _ 569112e0-421 e-58ef-be24-c2e42e5e53d2.html, published in the Sunday Edition, WDRB, Sep. 14, 2018, pp. 1-10.
FASTRACT 400 material data sheet Aug. 23, 2018, pp. 1-4.
https://www.youtube.com/watch?v=0CGi92UK4Tw, Optic Fiber nastro in Torino, published Mar. 7, 2016, Garbin Group, pp. 1-3.
https://www.youtube.com/watch?v=klWluvLc5cl, The Ditch Witch MT12 MicroTrencher: Faster, Cleaner, Better, published Jun. 14, 2016, pp. 1-4.
https://www.youtube.com/watch?v=VWryq2nOA3U, Micro trenching | MTT-system, published Sep. 26, 2016, www.mttsystem.com, pp. 1-3.
https://www.youtube.com/watch?v=7xf2Ujax9hU, published Nov. 10, 2011, Micro-Trenching—alternative Möglichkeit zur Verlegung von Glasfaserkabeln, Schmidt@buglas.de, pp.-1-3.
https://www.youtube.com/watch?v=OlxA3gqNPkE, BVS-net, microtrenching, published Nov. 29, 2014, www.bvs-net.eu, pp. 1-3.
https://www.youtube.com/watch?v=929vJtv5Uxw, www, dellcron.com, published Feb. 10, 2018, pp. 1-3.
https://www.youtube.com/watch?v=8p4xHlwuMhl, Americicom, www.americomtech.com, Microtrenching, published Jun. 10, 2017, pp. 1-3.
https://www.youtube.com/watch?v=57NBkB1y8iM, published Jan. 14, 2014, KNET Micro Trenching Solution, pp. 1-4.
Camplex Fiber Optic Extender, http://www.camplex.com/product.aspx?item=CMX-TACNGO-SDI, May 29, 2020, pp. 1-2.
Trenchers, www.samarais.com, Oct. 17, 2017, pp. 1-2.
Corning Fiber Optic Extenders, https://www.corning.com/worldwide/en/products/communication-networks/products/fiber.html, Oct. 17, 2017, pp. 1-7.
SC Polymer, https://www.surecretedesign.com/product/liquid-concrete-polymer/, Oct. 17, 2017, p. 1.
SCAG Giant VAC, http://www.giant-vac.com/, Oct. 17, 2017, pp. 1-2.
DR Power Vacuum, https://www.drpower.com/, Oct. 17, 2017, pp. 1-2.
Billy Goat vaccum, www.billygoat.com, Oct. 17, 2017, pp. 1-2.
Ditch Witch, www.ditchwitch.com, Oct. 17, 2017, p. 1.
Trenchers, www.vermeer.com, Oct. 17, 2017, pp. 1-15.

* cited by examiner

MICROTRENCHER HAVING AN IMPROVED VACUUM SYSTEM AND METHOD OF MICROTRENCHING

FIELD OF THE INVENTION

The invention generally relates to a microtrencher having an improved vacuum system and a method of microtrenching using the improved vacuum system.

BACKGROUND OF THE INVENTION

The microtrencher saw usually creates a pile of spoil (dirt, asphalt, concrete, etc.) alongside the formed microtrench and the microtrench must be carefully cleaned before laying the cable in the trench. The pile of spoil must then be removed. A fill, also referred to as cement or grout, is inserted into the trench on top of the cable or innerduct/microduct.

Industrial vacuum trailers have been used to remove the piled up spoil. However, the industrial vacuum trailers are slow, inefficient and do not provide a clean microtrench, especially when creating a microtrench more than 16 inches deep.

Installing new optical fiber networks in a city is expensive and time consuming. Many installations require a far deeper microtrench to provide enhanced protection, such as more than 16 inches deep, and often up to 26 inches deep. When cutting a deep microtrench, cleaning spoil from the microtrench is far more difficult. There is a great need for faster and less expensive installation of optical fiber networks.

SUMMARY OF THE INVENTION

The above objectives and other objectives can be obtained by a microtrencher having an improved vacuum system configured for continuously cutting a microtrench in a roadway and cleaning spoil from the microtrench comprising:

- a motorized vehicle;
- a side-discharge cutting wheel connected to the vehicle and being configured to continuously cut through a roadway to create a microtrench in the roadway and deposit spoil removed from the microtrench along at least one side of the microtrench;
- a cutting wheel shroud covering at least a portion of the side-discharge cutting wheel;
- a vacuum device comprising a storage container configured to contain spoil vacuumed from a microtrench; and
- a first side shroud disposed on at least one side of the cutting wheel shroud, the first side shroud being connected to the vacuum device and being configured to vacuum the spoil from the at least one side of the microtrench to the storage container.

The above objectives and other objectives can also be obtained a method of cutting a microtrench in a roadway comprising a method of continuously cutting a microtrench in a roadway comprising:

- providing a microtrencher comprising;
  - a motorized vehicle;
  - a side-discharge cutting wheel connected to the vehicle and being configured to continuously cut through a roadway to create a microtrench in the roadway and deposit spoil removed from the microtrench along at least one side of the microtrench;
  - a cutting wheel shroud covering at least a portion of the side-discharge cutting wheel;
  - a vacuum device comprising a storage container configured to contain spoil vacuumed from a microtrench; and
  - a first side shroud disposed on at least one side of the cutting wheel shroud, the first side shroud being connected to the vacuum device and being configured to vacuum the spoil from the at least one side of the microtrench to the storage container;
- cutting the microtrench in the roadway with side-discharge cutting wheel;
- depositing the spoil from the microtrench on at least one side the microtrench; and
- vacuuming the spoil through the first side shroud and into the storage container.

DETAILED DESCRIPTION OF THE INVENTION

Figure 1:
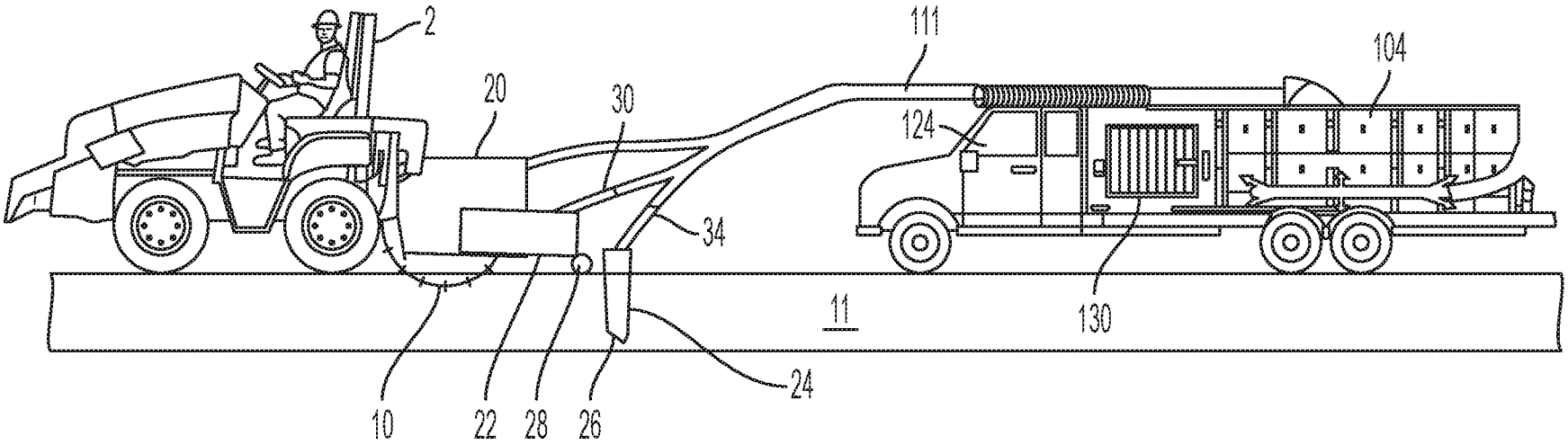
FIG. 1 illustrates an embodiment of the improved vacuum system being used in a method of cutting a microtrench.
Figure 2:
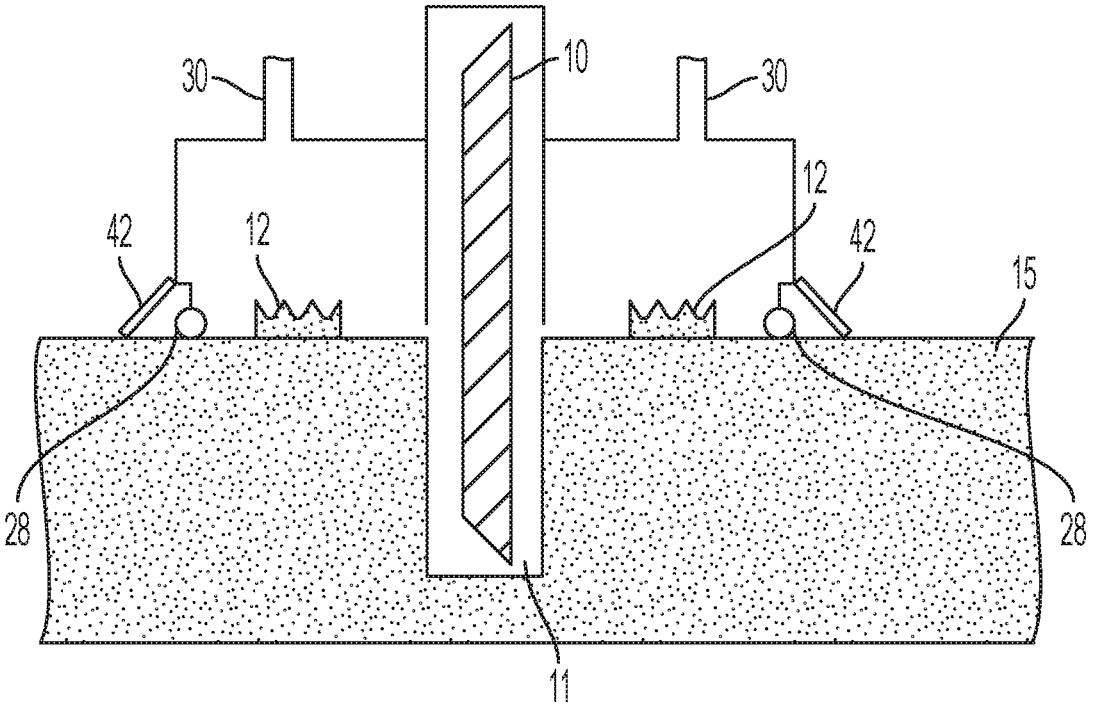
FIG. 2 illustrates a view of the improved vacuum system mounted on a microtrencher.
Figure 3:
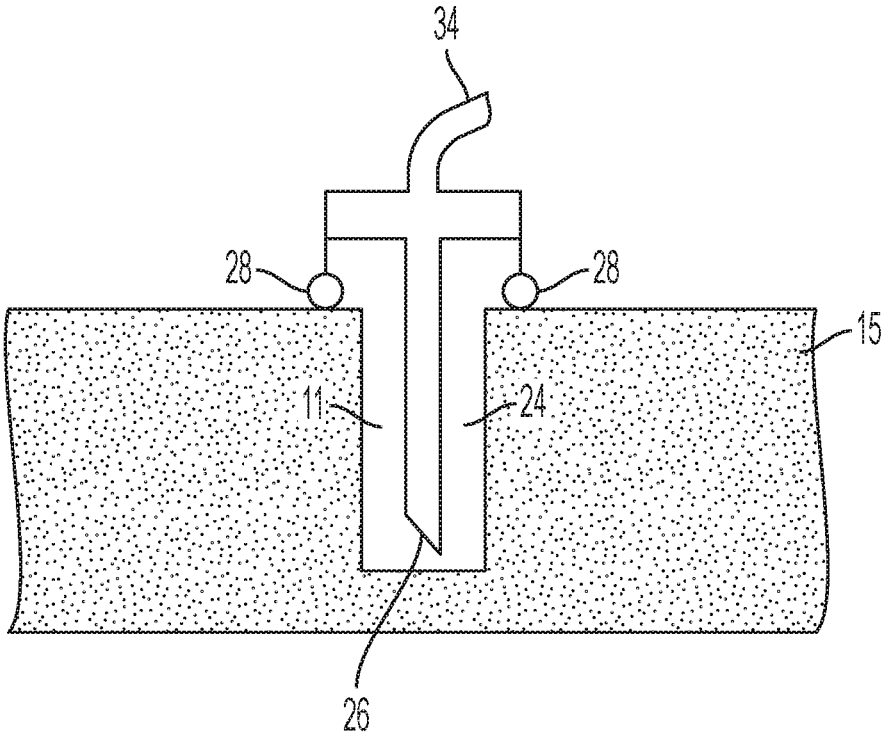
FIG. 3 illustrates a view of the improved vacuum system inserted in a microtrench.
Figure 4:
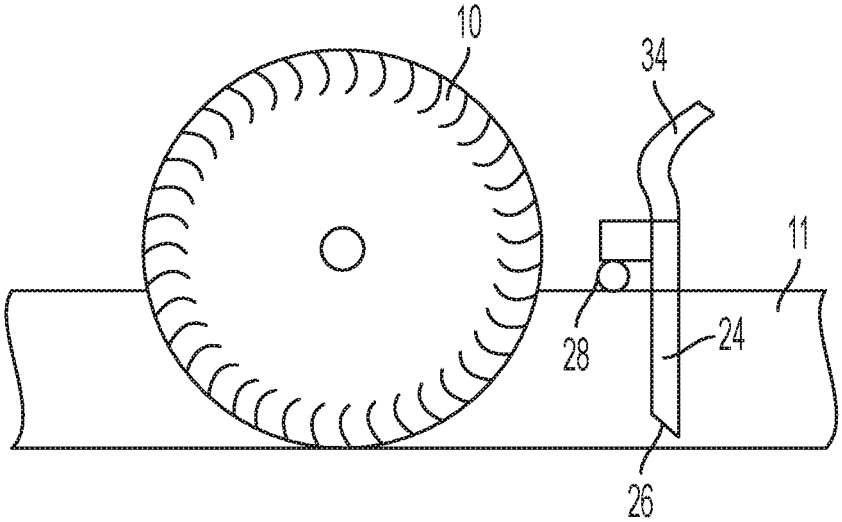
FIG. 4 illustrates a side view of the improved vacuum system inserted in a microtrench.
Figure 5:
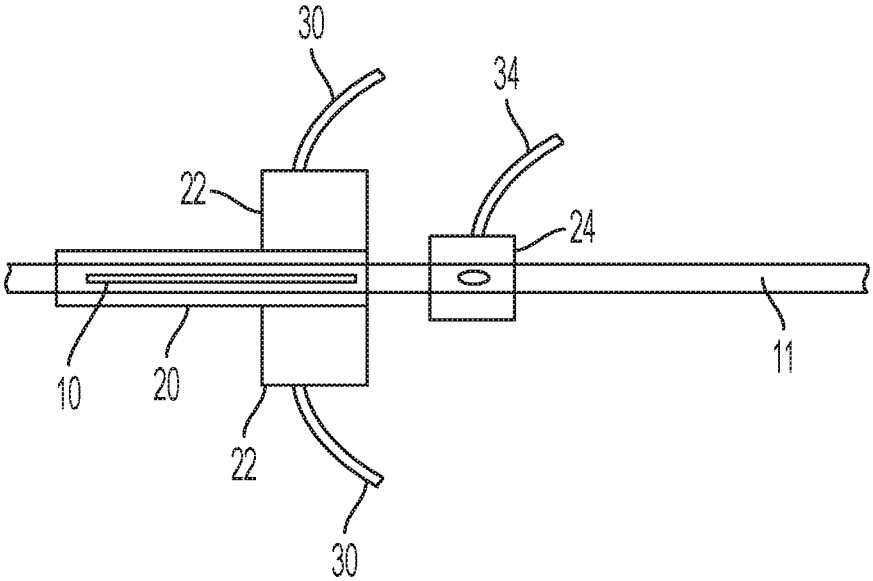
FIG. 5 illustrates a top view of the improved vacuum system inserted in a microtrench.
Figure 6:
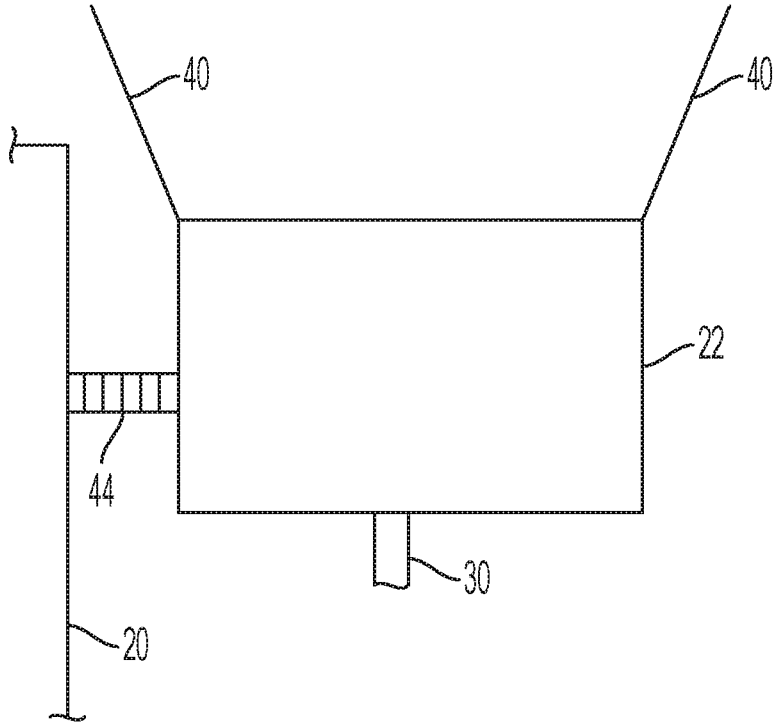
FIG. 6 illustrates a top view of the improved vacuum system mounted to a microtrencher.
Figure 7:
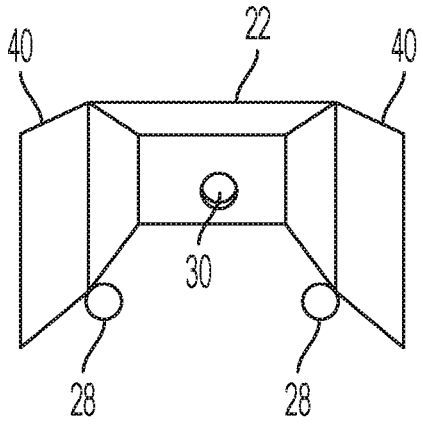
FIG. 7 illustrates a view of the improved vacuum system.
Figure 8:
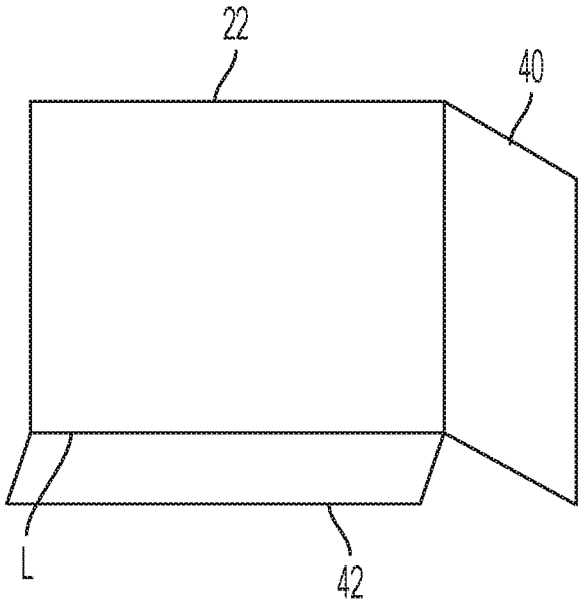
FIG. 8 illustrates a top view of the improved vacuum system.
Figure 9:
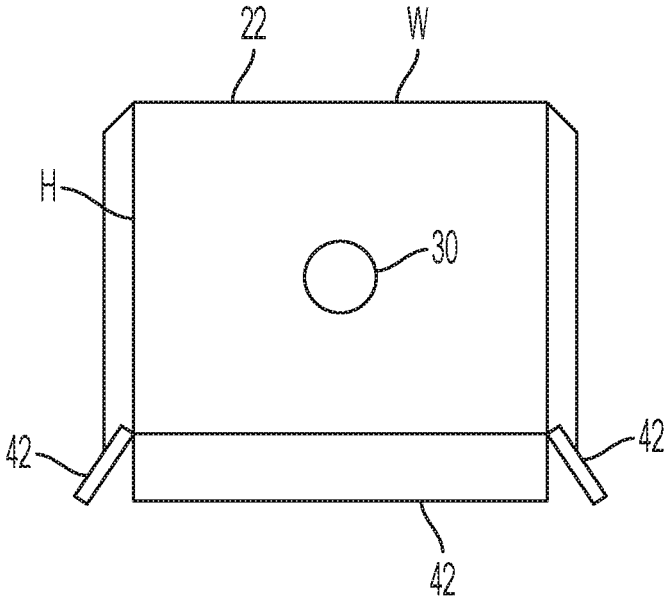
FIG. 9 illustrates a back view of the improved vacuum system.

In the following description, for purposes of explanation and not limitation, specific details are set forth, such as particular networks, communication systems, computers, terminals, devices, components, techniques, data and network protocols, software products and systems, operating systems, development interfaces, hardware, etc. in order to provide a thorough understanding of the present invention with reference to the attached non-limiting figures.

However, it will be apparent to one skilled in the art that the present invention may be practiced in other embodiments that depart from these specific details. Detailed descriptions of well-known networks, communication systems, computers, terminals, devices, components, techniques, data and network protocols, software products and systems, operating systems, development interfaces, and hardware are omitted so as not to obscure the description.

During installation of the optical fiber, a microtrench is cut in a roadway, the optical fiber and/or innerduct/microduct is laid in the microtrench and then a fill and sealant are applied over the optical fiber and/or innerduct/microduct to protect them from the environment. Microtrenchers, other devices used in microtrenching, and methods of microtrenching that can be utilized in the present invention include the devices and methods described in my previous U.S. patent publication Nos. 20190226603, 20190086002, 20180292027, 20180156357, and 20180106015, the complete disclosures of which are incorporated in their entirety herein by reference.

Any suitable microtrencher 2 can be utilized in the present invention. Non-limiting examples of suitable micro trenchers include those made and sold by Ditch Witch, Vermeer, and Marais. A Vermeer RTX 1250 tractor can be used as the motorized vehicle for the microtrencher 2. A microtrencher 2 is a "small rock wheel" specially designed for work in rural or urban areas. The microtrencher 2 is fitted with a cutting wheel 10 that cuts a microtrench 11 with smaller dimensions than can be achieved with conventional trench digging equipment. Microtrench 11 widths usually range from about 6 mm to 130 mm (¼ to 5 inches) with a depth of 750 mm (about 30 inches) or less. Other widths and depths can be used as desired.

With a microtrencher 2, the structure of the road, sidewalk, driveway, or path is maintained and there is no associated damage to the road. Owing to the reduced microtrench 11 size, the volume of waste material (spoil 12) excavated is also reduced. Microtrenchers 2 are used to minimize traffic or pedestrian disturbance during cable laying. A microtrencher 2 can work on sidewalks or in narrow streets of cities, and can cut harder ground than a chain trencher, including cutting through for example but not limited to solid stone, concrete, and asphalt. The term ground as used herein includes, son, asphalt, stone, concrete, grass, dirt, sand, brick, cobblestone, or any other material the trench 11 is cut into and the optical fiber buried within.

Vermeer discloses on its website www.vermeer.com that "Microtrenching is an installation method in which a narrow and relatively shallow trench is cut, typically on one side of an asphalt roadway. Trench dimensions range from 0.75"-2.25" (19.1 mm-57.2 mm) wide and 8"-16" (20.3 cm-40.6 cm) deep. While cutting, a vacuum system connected to the cutter wheel attachment cleanly diverts and transports the dry and dusty spoil away from the worksite. Once the conduit pipe is laid, the trench is backfilled with a grout compound." However, while attaching conventional vacuum systems to the cutter wheel attachment may work satisfactory for depths up to 16 inches, Vermeer's systems are not capable of adequately removing spoil from deeper microtrenches.

Vermeer has not solved the problems with quickly and efficiently removing the spoil from the roadway and a microtrench having a depth more than 16 inches. Additional crew members and equipment are currently required and used to clean up the spoil and ensure no spoil remains in the microtrench. This problem is further exacerbated by the increased speed of microtrenching achieved by my novel methods of microtrenching.

To solve this problem, I used a side-discharge cutting wheel 10 having a size sufficient to cut a microtrench 11 deeper than 16 inches. For example, I have cut a microtrench 11 up to 26 inches deep, and the depth can be deeper as required for the particular application. The term "side-discharge cutting wheel 10" includes any microtrench cutting wheel configured to deposit the spoil 12 to a side or both sides of the cut microtrench 11, examples of which are conical and diamond cutting wheels.

FIGS. 1-9 show an exemplary embodiment of the present invention. A microtrencher 2 is used to cut a microtrench 11. The microtrencher 2 has a cutting wheel shroud 20 covering at least a portion of the side-discharge cutting wheel 10. The side-discharge cutting wheel 10 deposits spoil 12 to the side of the microtrench 11. A side shroud 22 is connected to a source of vacuum and is configured to vacuum up the spoil 12. The side shroud 22 can be connected to the cutting wheel shroud 20 that covers at least a portion of the side-discharge cutting wheel 10. The side shroud 22 can be connected to the cutting wheel shroud 20 by a shroud positioner 44 which can adjust the position of the side shroud 22 in relation to the cutting wheel shroud 22, preferably in all directions, up, down, left or right. For example, the shroud positioner 44 can include a spring loaded mechanism similar to a shock absorber that forces the side shroud 22 to ride snugly or biased against the roadway surface.

The side shroud 22 can have any desired size and shape, depending upon the size and shape of the cutting wheel shroud 20. For example, the side shroud can have a width W of 6 to 30 inches, a height H of 6 to 30 inches and a length L of 6 to 30 inches. The side shroud 22 can be formed of any desired material, such as metal, plastic or composites. Side shrouds 22 can be mounted on both sides of the cutting wheel shroud 20. The side shroud 22 has a vacuum attachment 30 for connection to the source of vacuum. The side shroud 22 defines a chamber having an opening for the spoil 12 to enter. A flap 40 can be provided on one or both sides of the opening to guide the spoil 12 into the chamber. The flap 40 can be adjustable to open or close to provide a wider or narrower path for the spoil 12 to enter the opening. The spoil 12 in the chamber is sucked into the vacuum attachment 30. The side shroud 22 can be on wheels 28 so that the side shroud 22 can glide along the roadway surface during use. The sides of the side shroud 22 can be provided with roadway seals 42 to at least partially seal the side shroud 22 to the roadway surface during use and increase the flow of air into the opening of the side shroud 22 during use. The front of the side shroud 22 can have ski like tips on the flaps 40 or the walls of the side shroud 22 allowing the side shroud 22 to glide over rocks, debris or uneven surfaces of the roadway.

A suction nozzle 24 is configured to be inserted into the microtrench 11 to vacuum out any remaining soil 12. The suction nozzle 24 has an opening 26 at a bottom end to suck spoil 12 from the microtrench and a nozzle vacuum attachment 30 at an opposing end. The suction nozzle 24 is elongated and has a central hollow chamber. The length of the nozzle 24 can be any desired length, such as up to 30 inches. The width of the nozzle 24 should be sized to fit within the microtrench 11, such as less than 5 inches. The suction nozzle 24 can be on wheels 28 and be depth adjustable to adjust how far the suction nozzle 24 is inserted into the microtrench 11.

The source of vacuum can be any desired vacuum device 130, such as those made by SCAG Giant Vac., DR Power, Vermeer, and Billy Goat. A preferred source of vacuum is a Guzzler vacuum truck, www.guzzler.com. The Guzzler type vacuum truck 124 has a large storage container 104 for holding spoil 12 and a vacuum device 130 for creating a vacuum in the storage container 104. The storage container 104 is sized to hold spoil 12 created by the side-discharge cutting wheel 10 cutting a microtrench 11 in the roadway 15. The vacuum device 130 has an inlet 111 that can be connected to the side shroud(s) 22, cutting wheel shroud 20 and the suction nozzle 24. The Guzzler vacuum truck can provide sufficient vacuum to the side shrouds 22, suction nozzle 24 and the cutting wheel shroud 20 so that the speed of microtrenching can be greatly increased and still provide a clean microtrench 11. Furthermore, the large storage container 104 provides a long running time for the microtrencher 2 before having to be emptied. While FIG. 1 shows use of the truck 124, the truck 124 can be replaced with any suitable vacuum device 130.

Figure 10:
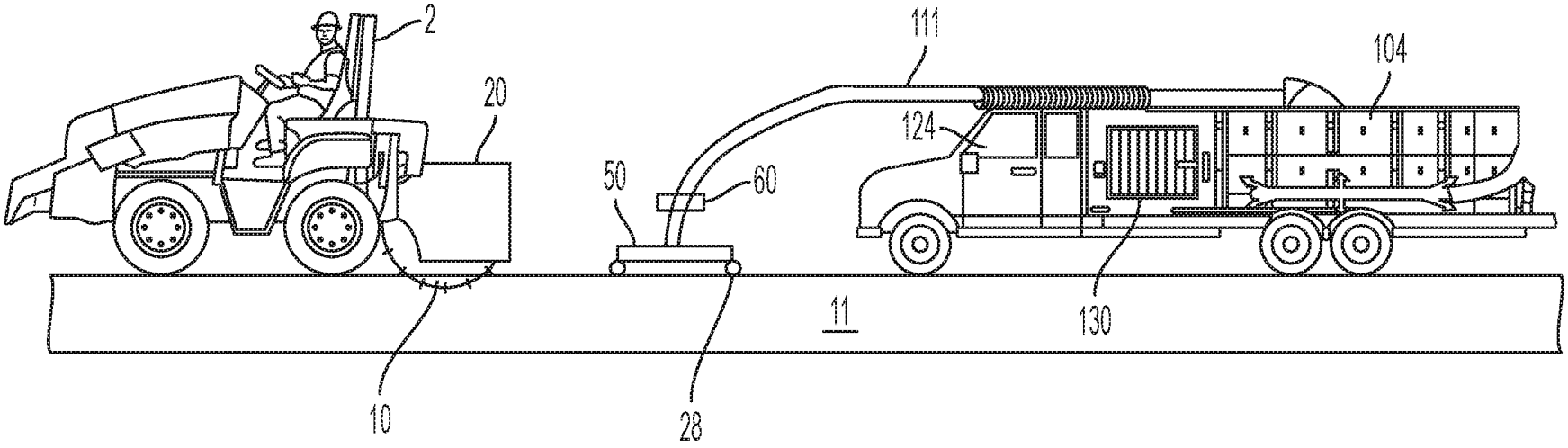
FIG. 10 illustrates a view of another embodiment of the improved vacuum system being used to cut a microtrench in which a vacuum head attachment is connected to a vacuum truck.

FIG. 10 illustrates another embodiment of the invention. The vacuum truck 124 can be provided with a vacuum head attachment 50 having optional wheels 28. The vacuum head attachment 50 can be rotated or moved as desired to vacuum up the spoil 12. The vacuum head attachment 50 can be used alone or in combination with the side shroud 22 and/or suction nozzle 24. FIGS. 11-14 show different vacuum head attachments 50 having a vacuum attachment 60 for attaching the vacuum head attachment 50 to a source of vacuum. The suction nozzle 64 operates in the same way as the suction nozzle 24.

Figure 11:
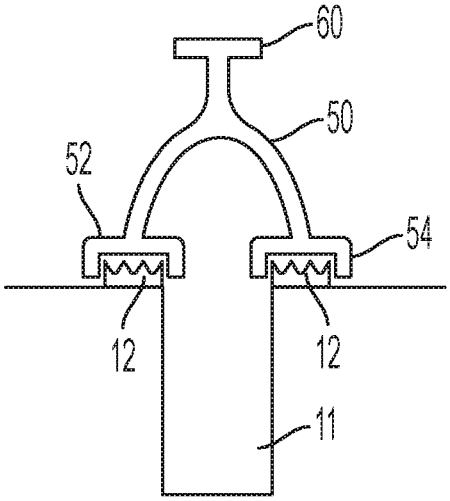
FIG. 11 illustrates an example a vacuum head attachment.
Figure 12:
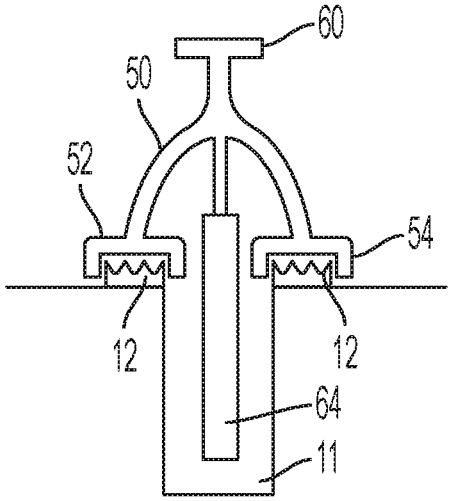
FIG. 12 illustrates an example a vacuum head attachment.
Figure 13:
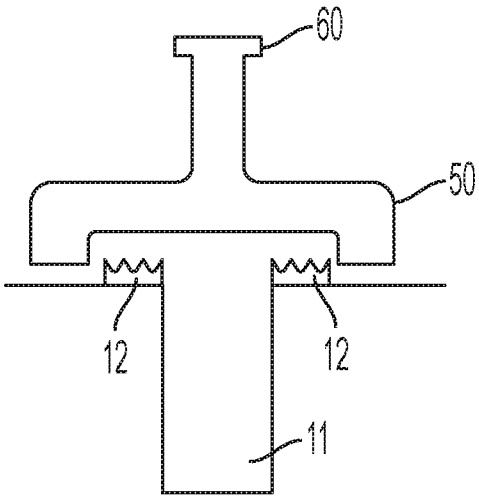
FIG. 13 illustrates an example a vacuum head attachment.
Figure 14:
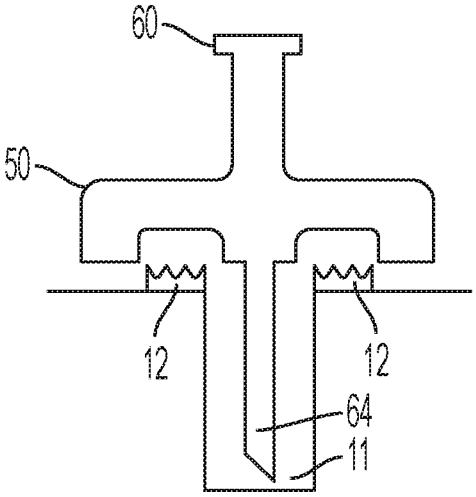
FIG. 14 illustrates an example a vacuum head attachment.
Figure 15:
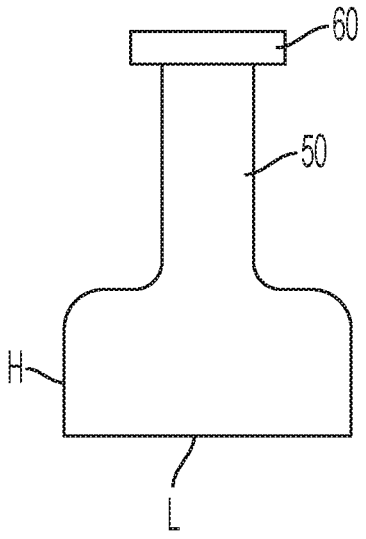
FIG. 15 illustrates a side view of a vacuum head attachment.
Figure 16:
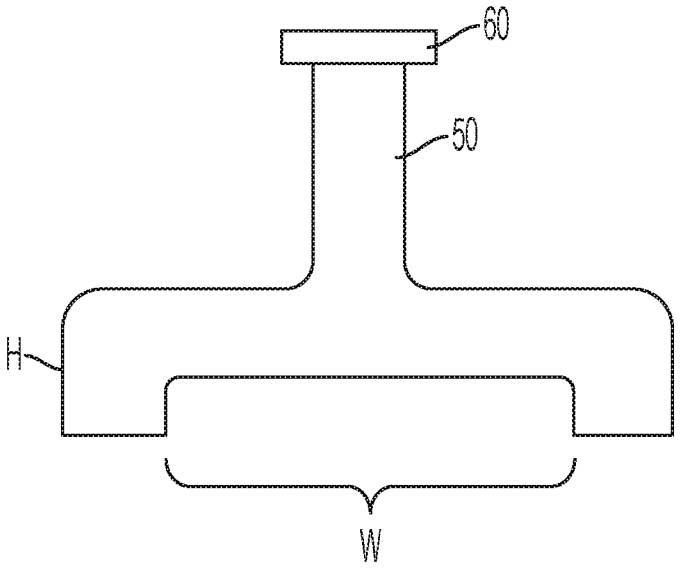
FIG. 16 illustrates a front view of a vacuum head attachment.

FIG. 11 shows a vacuum head attachment 50 have two side shrouds 52 and 54 which are configured to vacuum up spoil 12 from both sides of the microtrench 11. FIG. 12 shows a vacuum head attachment 50 have two side shrouds 52 and 54 which are configured to vacuum up spoil 12 from both sides of the microtrench 11 and a suction nozzle 64 to vacuum up spoil 12 from the microtrench 11. FIG. 13 illustrates a vacuum head attachment 50 have a large opening to vacuum spoil 12 from both sides of the microtrench 11 and an area over the microtrench 11. FIG. 14 illustrates a vacuum head attachment 50 have a large opening to vacuum spoil 12 from both sides of the microtrench 11 and an area over the microtrench 11, and also a suction nozzle 64 to vacuum up spoil 12 from the microtrench 11. The vacuum attachment 60 can be attached to a vacuum device 130 to provide a vacuum to the vacuum head attachment 50. The vacuum head attachment 50 can be sized for the particular application as desired. For example, in FIGS. 11 and 12, the width W of each of the openings can be from 6-30 inches when sized for vacuuming each side of the microtrench 11 separately. In FIGS. 13 and 14, when vacuuming both sides of the microtrench 11 and the area over the microtrench 11 simultaneously, for example, the width 2 can be from 12-60 inches. The length L can be, for example, 6 to 30 inches, or any size as desired. The height H can be any desired height.

Figure 17:
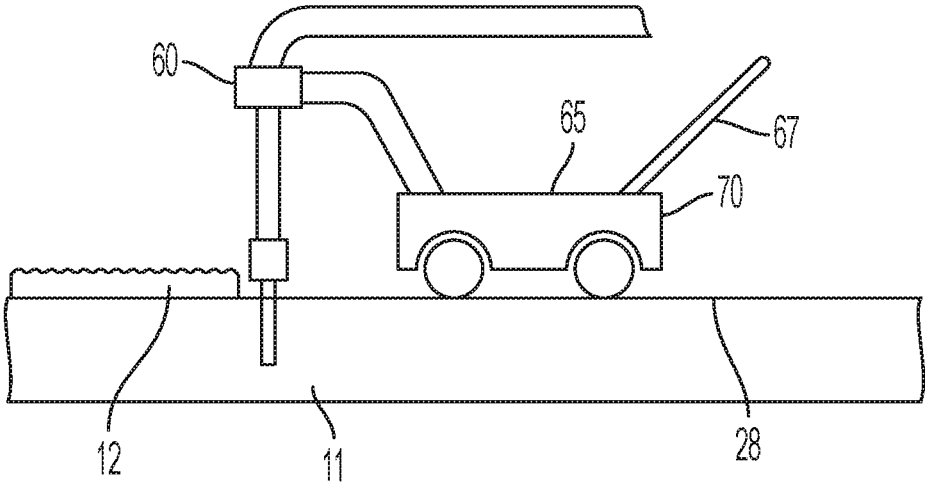
FIG. 17 illustrates the vacuum head attachment attached to a push cart.
Figure 18:
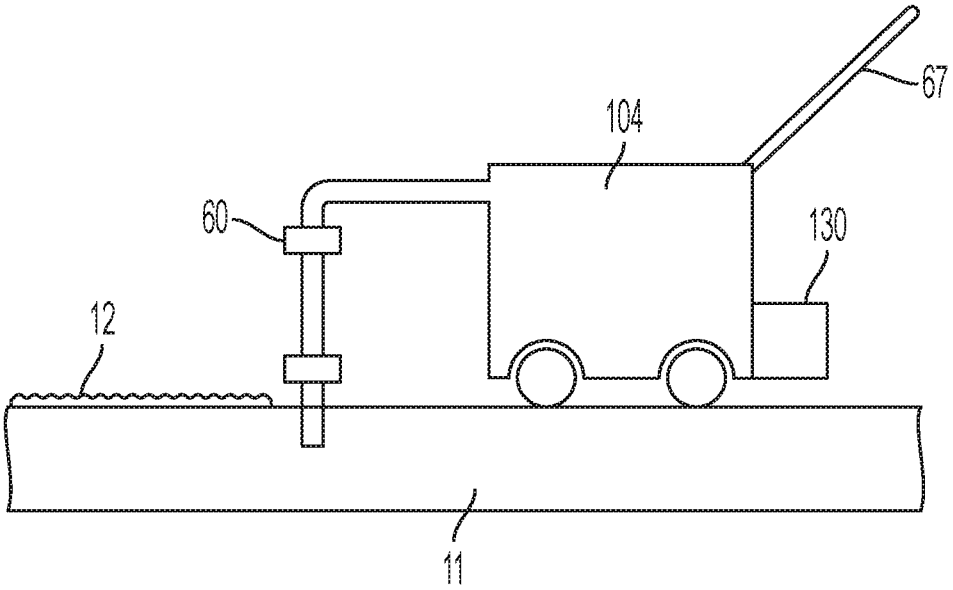
FIG. 18 illustrates the vacuum head attachment attached to a vacuum device.

FIG. 17 shows the vacuum head attachment 50 attached to a push cart 70 that can be pushed by a user. The push cart can have a body 65, a push handle 67 connected to the body, and wheels 28 connected to the body. FIG. 18 shows the vacuum head attachment 50 attached to a vacuum device 130 that can be pushed or self-powered walk behind by a user, such as such as those made by SCAG Giant Vac., DR Power, Vermeer, and Billy Goat.

Figure 19:
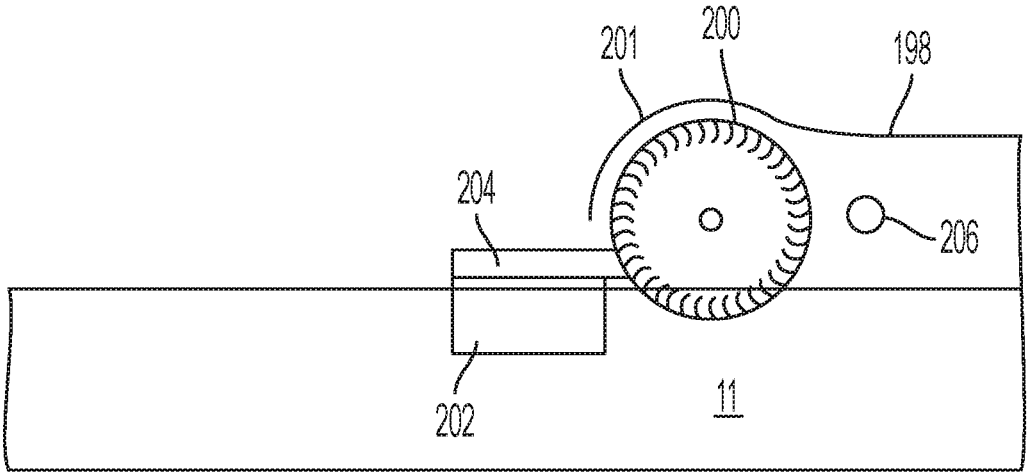
FIG. 19 illustrates a side view of a modified street sweeper.
Figure 20:
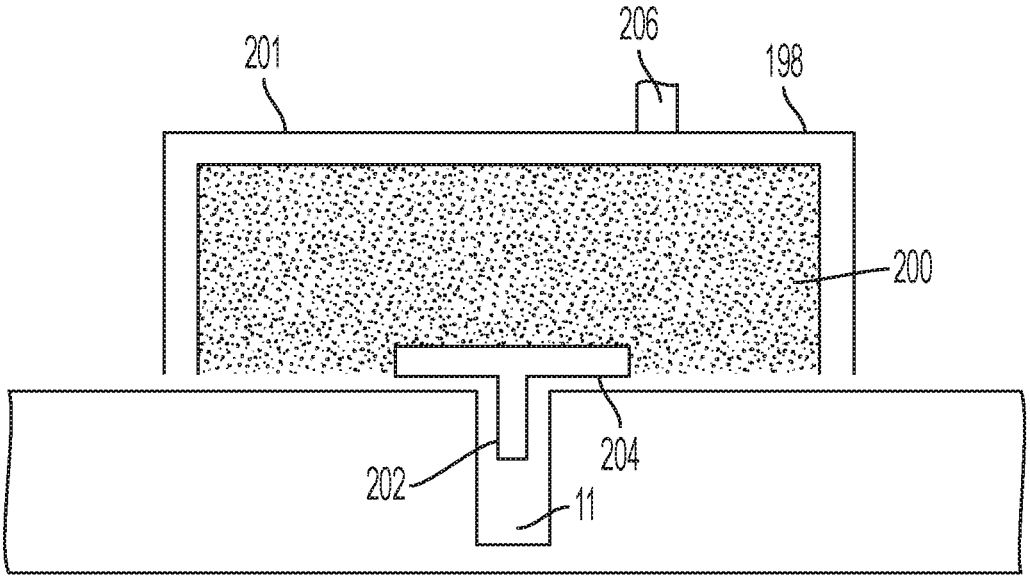
FIG. 20 illustrates a front view of a modified street sweeper.
Figure 21:
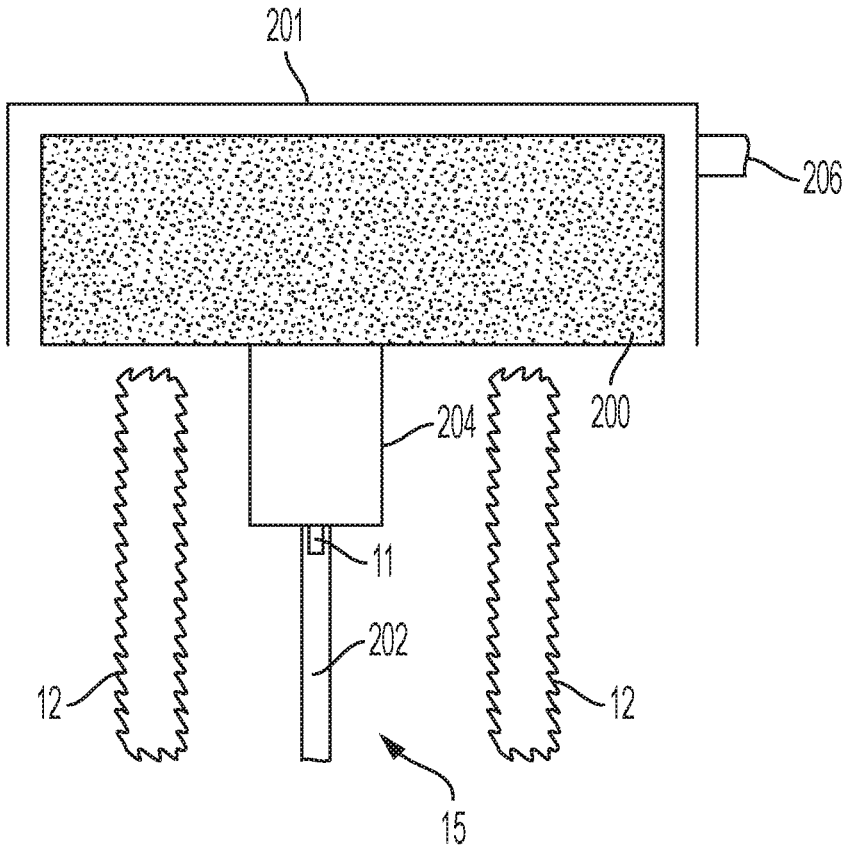
FIG. 21 illustrates a top view of a modified street sweeper.

Street sweepers are now well-known in the art and, thus, the conventional structures of a street sweeper will not be discussed herein, including the vehicle having a motor, wheels, frame, etc., and how the street sweeper operates. FIGS. 19-21 illustrate a modified street sweeper 198 having a rotating brush 200 for sweeping spoil 12 from the roadway 15 surrounding the microtrench 11. A microtrench guide 202 is attached to the street sweeper 198 to keep the rotating brush 200 aligned with the microtrench 11. The microtrench guide 202 can an adjustable width for use with different microtrench 11 widths. The microtrench guide 202 can be sized as desired. For example, the width can be about 0.5 to about 5 inches and the length can be from about 0.5 inch to about 12 inches. The microtrench guide 202 can also include a microtrench seal 204 that prevents spoil 12 from falling back into the microtrench 11 during sweeping with the rotating brush 200. The microtrench seal 204 can be sized as desired. The microtrench seal 204 can have an adjustable width. For example, the width can be from about 1 to about 12 inches and the length from about 1 inch to about 3 feet. A vacuum attachment 206 can attached to the shroud 201 at least partially surrounding the rotating brush 200 to provide a vacuum inside the street sweeper 198 and vacuum spoil 12 swept up by the rotating brush 200.

My invention provides numerous advantages over the previous methods. Additional crew and equipment are no longer necessary to clean the microtrench 11. During use of the improved vacuum system, the microtrencher 2 can now continuously cut a microtrench 11 while efficiently and quickly removing the spoil 12 from the roadway 15 and microtrench 12 using the side shrouds 22 and the suction nozzle 24 and the spoil collected in the storage container 104, all without the use of additional road crew and machinery. The improved vacuum system results in significantly faster microtrenching speeds and far less disruption to traffic.

To facilitate an understanding of the principles and features of the various embodiments of the present invention, various illustrative embodiments are explained below. Although example embodiments of the present invention are explained in detail, it is to be understood that other embodiments are contemplated. Accordingly, it is not intended that the present invention is limited in its scope to the details of construction and arrangement of components set forth in the following description or examples. The present invention is capable of other embodiments and of being practiced or carried out in various ways.

As used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the example embodiments, terminology will be resorted to for the sake of clarity. It is intended that each term contemplates its broadest meaning as understood by those skilled in the art and includes all technical equivalents that operate in a similar manner to accomplish a similar purpose.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified. Such other components or steps not described herein can include, but are not limited to, for example, similar components or steps that are developed after development of the disclosed technology.

It is to be understood that the foregoing illustrative embodiments have been provided merely for the purpose of explanation and are in no way to be construed as limiting of the invention. Words used herein are words of description and illustration, rather than words of limitation. In addition, the advantages and objectives described herein may not be realized by each and every embodiment practicing the present invention. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention.

The invention claimed is:

1. A microtrencher having a vacuum system configured for continuously cutting a microtrench in a roadway and cleaning spoil from the microtrench comprising:

a motorized vehicle;

a side-discharge cutting wheel connected to the vehicle and being configured to continuously cut through a roadway to create a microtrench in the roadway and deposit spoil removed from the microtrench along at least one side of the microtrench;

a cutting wheel shroud covering at least a portion of the side-discharge cutting wheel;

a vacuum device comprising a storage container configured to contain spoil vacuumed from a microtrench; and a first side shroud disposed on at least one side of the cutting wheel shroud, the first side shroud being connected to the vacuum device and being configured to vacuum the spoil from the at least one side of the microtrench to the storage container, wherein the first side shroud comprises at least one road seal configured to at least partially seal a side wall of the side shroud to the roadway.

2. The microtrencher according to claim 1, further comprising a second side shroud disposed on an opposite side of the cutting wheel shroud as the first side shroud, the second side shroud being connected to the vacuum device and being configured to vacuum the spoil from the at least one side of the microtrench to the storage container.

3. The microtrencher according to claim 1, wherein the first side shroud comprises at least one wheel configured to drive on the roadway.

4. The microtrencher according to claim 1, wherein the first side shroud comprises at least one flap configured to direct the spoil into a chamber within the side shroud.

5. A microtrencher having a vacuum system configured for continuously cutting a microtrench in a roadway and cleaning spoil from the microtrench comprising:

a motorized vehicle;

a side-discharge cutting wheel connected to the vehicle and being configured to continuously cut through a roadway to create a microtrench in the roadway and deposit spoil removed from the microtrench along at least one side of the microtrench;

a cutting wheel shroud covering at least a portion of the side-discharge cutting wheel;

a vacuum device comprising a storage container configured to contain spoil vacuumed from a microtrench;

a first side shroud disposed on at least one side of the cutting wheel shroud, the first side shroud being connected to the vacuum device and being configured to vacuum the spoil from the at least one side of the microtrench to the storage container; and a suction nozzle configured to be inserted into the microtrench and being connected to the vacuum device, and the suction nozzle comprising an elongated body defining a hollow chamber with an opening at one end and a vacuum connector at an opposing end.

6. The microtrencher according to claim 5, further comprising at least one wheel on the suction nozzle configured to drive on the roadway.

7. A microtrencher having a vacuum system configured for continuously cutting a microtrench in a roadway and cleaning spoil from the microtrench comprising:

a motorized vehicle;

a side-discharge cutting wheel connected to the vehicle and being configured to continuously cut through a roadway to create a microtrench in the roadway and deposit spoil removed from the microtrench along at least one side of the microtrench;

a cutting wheel shroud covering at least a portion of the side-discharge cutting wheel;

a vacuum device comprising a storage container configured to contain spoil vacuumed from a microtrench;

a first side shroud disposed on at least one side of the cutting wheel shroud, the first side shroud being connected to the vacuum device and being configured to vacuum the spoil from the at least one side of the microtrench to the storage container; and a shroud positioner configured to connect the first side shroud to the cutting wheel shroud.

8. The microtrencher according to claim 7, wherein the shroud positioner includes a spring loaded mechanism that forces the first side shroud to ride snugly or biased against the roadway.

9. The microtrencher according to claim 7, wherein the shroud positioner is configured to move the first side shroud in relation to the cutting wheel shroud.

10. A method of continuously cutting a microtrench in a roadway comprising:

providing a microtrencher comprising;

a motorized vehicle;

a side-discharge cutting wheel connected to the vehicle and being configured to continuously cut through a roadway to create a microtrench in the roadway and deposit spoil removed from the microtrench along at least one side of the microtrench;

a cutting wheel shroud covering at least a portion of the side-discharge cutting wheel;

a vacuum device comprising a storage container and configured to create a vacuum in the storage container and contain spoil vacuumed from a microtrench; and a first side shroud disposed on at least one side of the cutting wheel shroud, the first side shroud being connected to the vacuum device and being configured to vacuum the spoil from the at least one side of the microtrench to the storage container;

cutting the microtrench in the roadway with side-discharge cutting wheel;

depositing the spoil from the microtrench on at least one side the microtrench; and vacuuming the spoil through the first side shroud and into the storage container, wherein the first side shroud comprises at least one road seal configured to at least partially seal a side wall of the side shroud to the roadway and the method further comprises at least partially sealing the side wall to the roadway with the road seal.

11. The method according to claim 10, wherein the microtrencher further comprising a second side shroud disposed on an opposite side of the cutting wheel shroud as the first side shroud, the second side shroud being connected to the vacuum device and being configured to vacuum the spoil from the at least one side of the microtrench to the storage container and the method further comprises vacuuming the spoil through the second side shroud and into the storage container.

12. The method according to claim 10, wherein the first side shroud comprises at least one wheel configured to drive on the roadway and the method further comprises using the wheel to drive on the roadway.

13. The method according to claim 10, wherein the first side shroud comprises at least one flap configured to direct the spoil into a chamber within the side shroud and the method further comprises directing the spoil into the chamber with the at least one flap.

14. A method of continuously cutting a microtrench in a roadway comprising:

providing a microtrencher comprising;

a motorized vehicle;

a side-discharge cutting wheel connected to the vehicle and being configured to continuously cut through a roadway to create a microtrench in the roadway and deposit spoil removed from the microtrench along at least one side of the microtrench;

a cutting wheel shroud covering at least a portion of the side-discharge cutting wheel;

a vacuum device comprising a storage container and configured to create a vacuum in the storage container and contain spoil vacuumed from a microtrench; and a first side shroud disposed on at least one side of the cutting wheel shroud, the first side shroud being connected to the vacuum device and being configured to vacuum the spoil from the at least one side of the microtrench to the storage container;

cutting the microtrench in the roadway with side-discharge cutting wheel;

depositing the spoil from the microtrench on at least one side the microtrench;

vacuuming the spoil through the first side shroud and into the storage container; and using a suction nozzle inserted into the microtrench and connected to the vacuum device to suction spoil from the microtrench.

15. The method according to claim 14, further comprising at least one wheel on the suction nozzle and using the wheel to drive on the roadway.

16. A method of continuously cutting a microtrench in a roadway comprising:

providing a microtrencher comprising;

a motorized vehicle;

a side-discharge cutting wheel connected to the vehicle and being configured to continuously cut through a roadway to create a microtrench in the roadway and deposit spoil removed from the microtrench along at least one side of the microtrench;

a cutting wheel shroud covering at least a portion of the side-discharge cutting wheel;

a vacuum device comprising a storage container and configured to create a vacuum in the storage container and contain spoil vacuumed from a microtrench;

a first side shroud disposed on at least one side of the cutting wheel shroud, the first side shroud being connected to the vacuum device and being configured to vacuum the spoil from the at least one side of the microtrench to the storage container; and a shroud positioner configured to connect the first side shroud to the cutting wheel shroud and using the shroud positioner to connect the first side shroud to the cutting wheel shroud;

cutting the microtrench in the roadway with side-discharge cutting wheel;

depositing the spoil from the microtrench on at least one side the microtrench;

vacuuming the spoil through the first side shroud and into the storage container.

17. The method according to claim 16, wherein the shroud positioner includes a spring loaded mechanism and using the spring loaded mechanism to force the first side shroud to ride snugly or biased against the roadway.

18. The method according to claim 16, further comprising using the shroud positioner to position the first side shroud in relation to the cutting wheel shroud.

* * * * *